US007208866B2

(12) United States Patent
Chiou et al.

(10) Patent No.: US 7,208,866 B2
(45) Date of Patent: Apr. 24, 2007

(54) FIELD EMISSION DISPLAY DEVICE

(75) Inventors: Jeng-Maw Chiou, Hsinchu (TW); Jon-Lian Kwo, Hsinchu (TW); Kwan-Jon Chang, Hsinchu (TW); Shy-Wen Lai, Hsinchu (TW); Ai-Kang Li, Hsinchu (TW); Hong-Jen Lai, Hsinchu (TW); Meiso Yokoyama, Hsinchu (TW)

(73) Assignee: Industrial Technology Research Industry, Chu-Tung, Hsinchu (TW)

( * ) Notice: Subject to any disclaimer, the term of this patent is extended or adjusted under 35 U.S.C. 154(b) by 125 days.

(21) Appl. No.: 10/868,221

(22) Filed: Jun. 16, 2004
(Under 37 CFR 1.47)

(65) Prior Publication Data

US 2005/0099112 A1 May 12, 2005

(30) Foreign Application Priority Data

Jun. 17, 2003 (TW) ..... 92116443 A

(51) Int. Cl.
*H01J 1/02* (2006.01)
*H01J 1/53* (2006.01)

(52) U.S. Cl. ..... 313/497; 313/309; 313/495

(58) Field of Classification Search ..... 313/309, 313/495, 497
See application file for complete search history.

(56) References Cited

U.S. PATENT DOCUMENTS 4,544,860 A 10/1985 Guest et al.
4,806,827 A 2/1989 Eschard
5,598,056 A * 1/1997 Jin et al. ..... 313/495
5,656,887 A * 8/1997 Voshell et al. ..... 313/496
5,751,109 A 5/1998 Payne
5,982,082 A 11/1999 Janning
6,215,243 B1 4/2001 Janning
6,323,594 B1 11/2001 Janning
6,414,442 B1 * 7/2002 Janning ..... 315/169.3
6,943,494 B2 * 9/2005 Chiou et al. ..... 313/496

FOREIGN PATENT DOCUMENTS

GB 2 109 264 A 6/1983

* cited by examiner

*Primary Examiner*—Edward J. Glick
*Assistant Examiner*—Anastasia S. Midkiff
(74) *Attorney, Agent, or Firm*—Birch, Stewart, Kolasch & Birch, LLP

(57) ABSTRACT

A field emission display device includes three parts: a cathode emitter unit, an electron amplification unit, and a faceplate unit. The primary emission of electrons emitted from the cathode emitter unit bombards an electrode layer that includes an electron amplification material in order to generate secondary emissions of electrons. The secondary emissions of electrons bombard a light-emitting layer of the faceplate unit to generate fluorescence. Then, the fluorescence is transmitted through a transparent faceplate for viewing.

11 Claims, 5 Drawing Sheets

FIELD EMISSION DISPLAY DEVICE

BACKGROUND OF THE INVENTION

This Nonprovisional application claims priority under 35 U.S.C. §119(a) on patent application Ser. No(s). 092116443 filed in TAWIAN, R.O.C. on Jun. 17, 2003, the entire contents of which are hereby incorporated by reference.

1. Field of Invention

The invention relates to a field emission display device, and more particularly to a field emission display device for use with flat panel displays.

2. Related Art

Cathode ray tube (CRT) designs have been the predominant display technology on the market for their advantages and low cost. To satisfy the variety of information products recently available, the demand for flat panel displays is urgent. The current market trend is toward being compact and saving electricity. Thus CRTs have been replaced by flat panel displays.

The main technologies that apply to flat panel displays are plasma displays, liquid crystal displays, electroluminescent displays, light emitting diodes, vacuum fluorescent displays, field emission displays, and electrochromic displays.

Display factory owners have paid attention to the field emission display since the Laboratorie d'Electronique de Technologieet d'Instrumentation disclosed the field emission display technology at the fourth International Vacuum Microelectronics conference.

The light emitting mechanism of the FED devices is the same as that in cathode ray tubes. But the FED devices get rid of the bulky and heavy drawbacks normally together with CRTs but still have their advantages in terms of superior color resolution, contrast and brightness over 100 fL, high yield, and fast response times.

Due to the advantage of superior color resolution, FED devices are very clear in high brightness environments. Thus the major applications of FED devices technology have been for military purposes, such as displays for airplane GPS and radar. Because FED devices in a transient state respond very fast and do not lag, pilots can quickly track enemies through FED devices.

Electron amplification structures applied to the FED devices have been developed. Electron amplification structures are used to increase the electron amplification factors. The electron amplification factors of the FED devices increase over 100–1000 times to increase the brightness of the FED devices.

As shown in FIG. 1, the FED device disclosed in U.S. Pat. No. 5,982,082 contains: a faceplate 38, an anode layer 42, barrier layers 52 and 54, a light emitting layer 40, black matrix separations 44, an amplification enhancement layer 50, a biasing electrode 46, spacings 51 and a cathode emitter 36.

The amplification enhancement layer 50 is bombarded by electrons emitted from the cathode emitter 36 in order to generate secondary emission of electrons. The secondary emission of electrons bombards the light-emitting layer 40 to generate fluorescence, which transmits through the faceplate 38 for viewing.

While a single emitter 36 is schematically illustrated for servicing of a single display pixel location, it will be understood that a matrix or multiplicity of cathode emitters may be used for providing images.

An amplification layer 50 thickness of about 120 Angstroms is presently preferred for effective amplification as well as transmission of primary emission energies and current for high-brightness display operations. With this thickness it is not easy to fabricate the amplification layer 50, and the amplification effect of the amplification layer 50 is limited. Also, the spacings 51 need some elements to separate, the compression resistance is lower and the structure is complex. Thus such large-sized FED devices cannot be easily produced.

As shown in FIG. 2, the segmented cold cathode display panel disclosed in U.S. Pat. No. 5,751,109 features a channel plate 33 used for electron amplification. The channel plate 33 contains an input 60 and an output 62. The input 60 and output 62 of the channel plate 33 are biased, respectively, at voltages of approximately 20 volts and 1000 volts, where the potential is stated with respect to the ground (not shown). This means that the channel plate 33 is a resistance layer. The channel plate 33 employs electron multiplying technology that is well known to the art. By providing for multiple collisions between electrons and surfaces 41 that emit secondary electrons, gains of 10.sup.2 to 10.sup.4 in the flux of electrons may be achieved.

Even if there is no electron passing through the channel plate 33, the voltage potential between the input 60 and output 62 is large because of the finite resistance inside the channel plate 33. There is stationary power consumption ($p=V^2/R$) inside the channel plate 33. Besides, the segmented cold cathode display panel cannot meet the requirement of high resolution due to the difficulties of fabrication.

SUMMARY OF THE INVENTION

An object of the invention is therefore to provide a field emission display device, which comprises an electron amplification material for providing secondary or even repeated emission of electrons. The field emission display device, which is composed of many electrodes with the electron amplification material, provides greatly increased emission of electrons.

The field emission display device includes three parts: a cathode emitter unit, an electron amplification unit and a faceplate unit. The cathode emitter unit provides electrons for the light emitting mechanism of the field emission display device. The electrons are accelerated from the cathode emitter unit toward the faceplate unit by application of voltage potential between a plurality of electrodes of the cathode emitter unit and the faceplate unit.

When the electrons move upward, they bombard an electron amplification material of the electron amplification unit to generate secondary emission of electrons by the electron amplification effect.

The secondary emission of electrons moves upward by application of a voltage potential between the cathode emitter unit and the faceplate unit. Then, the secondary emission of electrons bombards a fluorescent material of the faceplate unit to generate fluorescence. The fluorescence is transmitted through the faceplate unit for observation.

The electron amplification unit provides electron amplification capability in addition to enhance structural strength in order to make the field emission display device more stable.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The present invention will become more fully understood from the detailed description given hereinbelow and the accompanying drawings which are given by way of illustration only, and thus are not limitative of the present invention, and wherein:

DETAILED DESCRIPTION OF THE INVENTION

Figure 1:
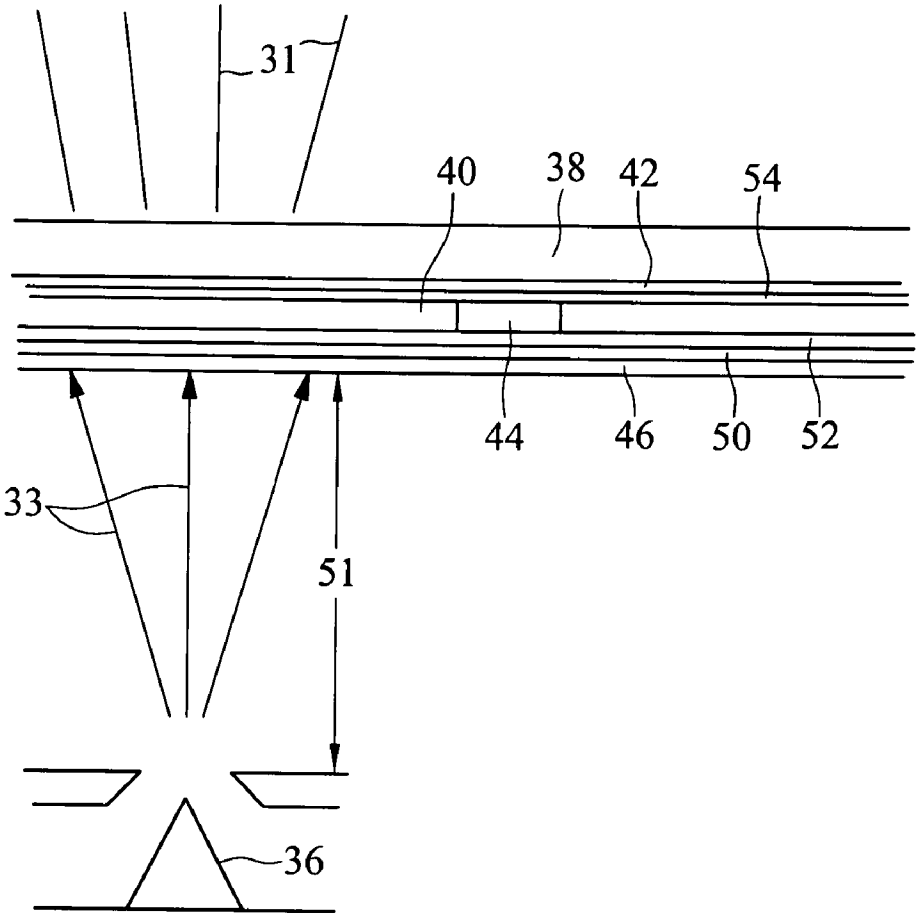
FIG. 1(PRIOR ART)
FIG. 1 is a cross-sectional schematic view of a FED device disclosed in U.S. Pat. No. 5,982,082.
Figure 2:
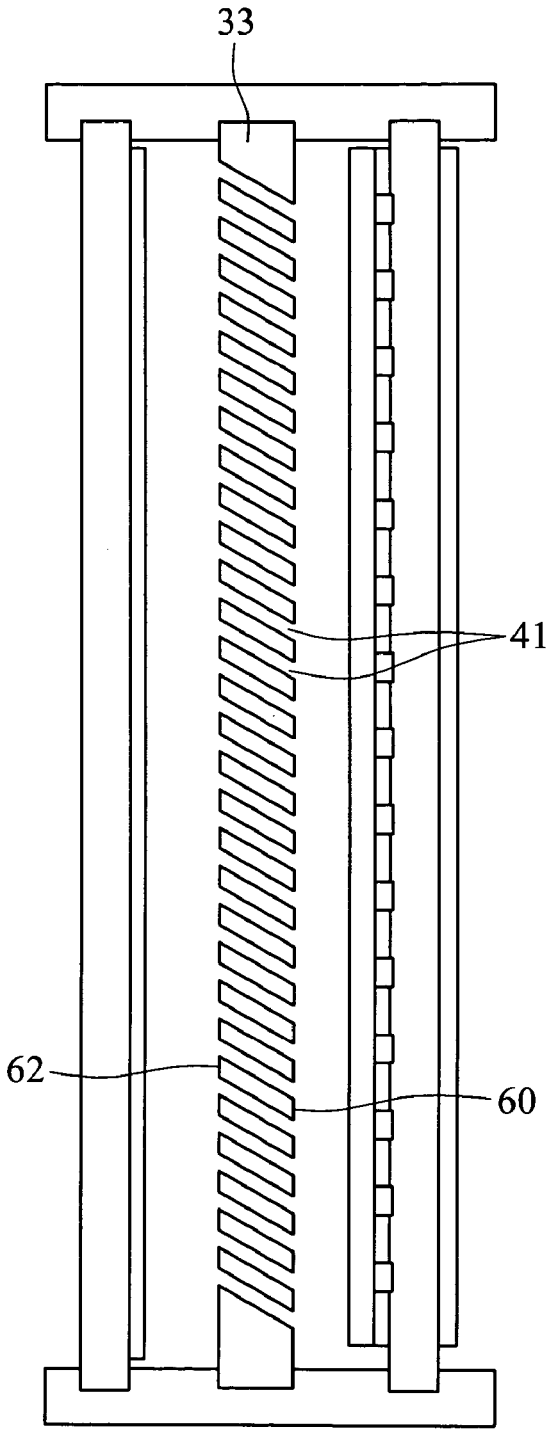
FIG. 2(PRIOR ART)
FIG. 2 is a cross-sectional schematic view of a segmented cold cathode display panel disclosed in U.S. Pat. No. 5,751,109.
Figure 3:
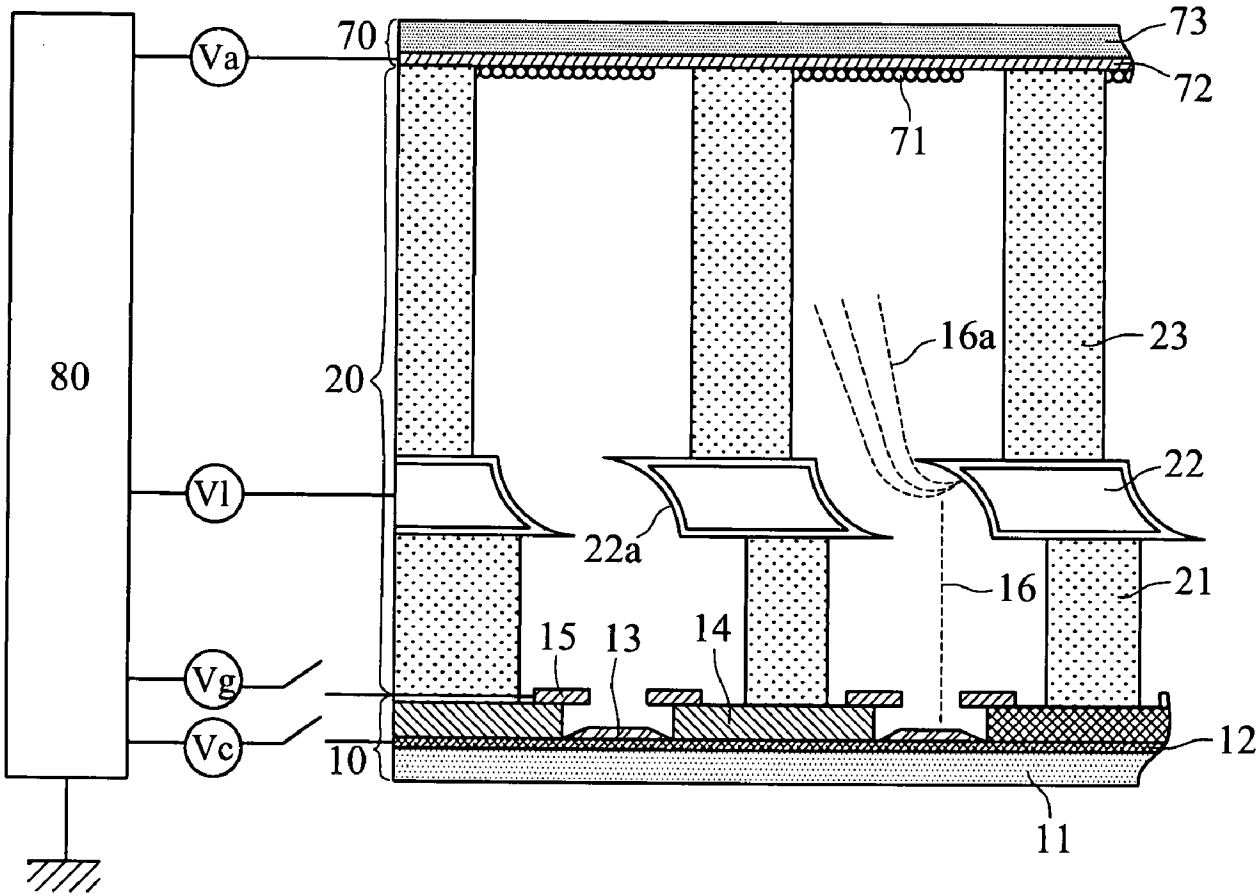
FIG. 3 is a cross-sectional schematic view of the FED device in a first embodiment of the invention.

As shown in FIG. 3, the first embodiment of the disclosed field emission display device contains: a cathode emitter unit 10, an electron amplification unit 20, and a faceplate unit 70.

The cathode emitter unit 10 is used for providing electrons to the light emitting mechanism of the field emission display device. The electrons are accelerated from the cathode emitter unit 10 toward the faceplate unit 70 by application of voltage potential between a plurality of electrodes of the cathode emitter unit 10 and the faceplate unit 70.

When the electrons move upward, they bombard an electron amplification material of the electron amplification unit 20 to generate secondary emission of electrons by electron amplification. For example, when bombarded with electrons of sufficient energy, 2 electrons are emitted for each electron reaching the electron amplification material. Then, the secondary emission of electrons moves upward by application of voltage potential between the cathode emitter unit 10 and the faceplate unit 70, and bombards a fluorescent material of the faceplate unit 70 to generate fluorescence for observation.

The cathode emitter unit 10 in the bottom of the field emission display device contains: a substrate 11, a first electrode 12, cathode emitters 13, first insulating layers 14, and second electrodes (gate electrodes) 15. The first electrode 12 is disposed upon the substrate 11. The cathode emitters 13 are disposed upon the first electrode 12 at appropriate positions. The cathode emitters 13 are made of a cathode emitting material for providing the primary emission of electrons.

The first insulating layer 14 is composed of insulators, and each cathode emitter 13 is electrically separated by insulators. The second electrodes 15 are disposed upon the adjacent insulation at corresponding positions. The first insulating layer 14 is used for providing electrical separation between the first electrode 12 and the second electrodes (gate electrodes) 15. Each cathode emitter 13 emitting the primary emission of electrons 16 at a predetermined time is controlled by the application of the voltage potential between the first electrode 12 and the second electrode 15.

Besides the cathode emitter unit 10 shown in FIG. 3, the cathode emitter unit 10 can also be a point emitter, a wedge emitter, a thin film amorphic diamond emitter, a thin film edge emitter, a surface emitter, an edge emitter, or a carbon nanotube emitter.

The electron amplification unit 20 is bombarded with the primary electrons emitted from the cathode emitter unit 10 to generate secondary emission of electrons. The electron amplification unit 20 includes a second insulating layer 21, a first electron amplification electrode 22, and a third insulating layer 23. The second insulating layer 21 is disposed upon the first insulating layer 14 and is composed of a plurality of insulating pillars or continuous structure with hollow tubes.

The first electron amplification electrode 22 is disposed upon the second insulating layer 21. The first electron amplification electrode 22 is biased to create a voltage potential with the first electrode 12. The primary emission of electrons 16 is attracted to the first electron amplification electrode 22 by the voltage potential.

The first electron amplification electrode 22 is a metal plate with many apertures 22*a*. Each aperture 22*a* has an inclined wall with the electron amplification material. The electron amplification material of the aperture 22*a* is bombarded with the primary emission of electrons 16 to generate secondary emission of electrons 16*a*.

Figure 4:
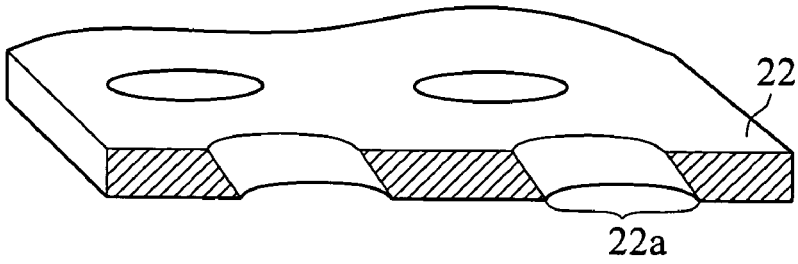
FIG. 4 is a cross-sectional schematic view of the aperture with a flat inclined plane.
Figure 5:
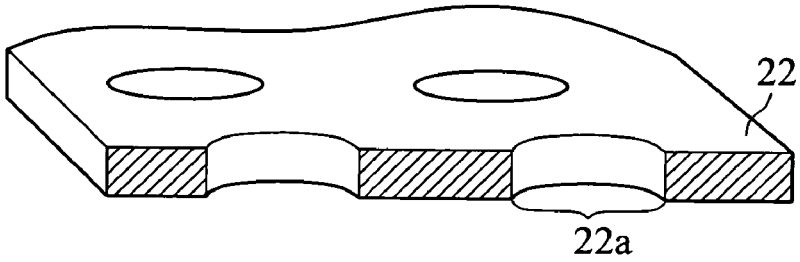
FIG. 5 is a cross-sectional schematic view of the aperture with a vertical plane.
Figure 6:
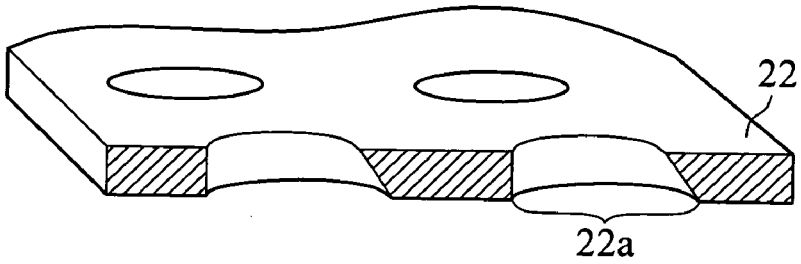
FIG. 6 is a cross-sectional schematic view of the aperture with both a vertical plane and a flat inclined plane.

As shown in FIG. 3, the shape of the wall inside the aperture 22*a* can be a concave inclined plane, a flat inclined plane shown in FIG. 4, or a vertical plane shown in FIG. 5. Also, as shown in FIG. 6, the shape of the wall inside the aperture 22*a* can be a combination of the vertical plane and the flat inclined plane, or any other two shapes of the wall. In addition, the wall inside the aperture 22*a* can be of other shapes depending on requirements.

The preferred electron amplification material of the aperture 22*a* can be an alloy such as an Ag—Mg alloy, a Cu—Be alloy, a Cu—Ba alloy, a Au—Ba alloy, a Au—Ca alloy, or a W—Ba—Au alloy. Otherwise, an oxide of beryllium, magnesium, calcium, strontium, barium, or other metal oxide with a high amplification factor can be used as the electron amplification material.

A third insulating layer 23 is disposed upon the first electron amplification electrode 22. The third insulating layer 23 is composed of a plurality of insulating pillars or continuous structure with hollow tubes. The electron amplification unit 20 is constructed of solid materials (the second insulating layer 21, the first electron amplification electrode 22, and the third insulating layer 23). So the electron amplification unit 20 has the functions of electron amplification, space support, and improving the strength of the field emission display device.

The faceplate unit 70 is on top of the field emission display device, and contains a light-emitting layer 71, an upper electrode layer 72, and a transparent faceplate 73. The upper electrode layer 72 is made of indium tin oxide (ITO) or other transparent conductive materials. The light-emitting layer 71 is on the lower surface of the upper electrode layer 72, and is composed of fluorescence or other light-emitting materials.

The transparent faceplate 73 is disposed upon the upper electrode layer 72 and is composed of glass or other transparent materials. When the light-emitting layer 71 is bombarded with the secondary emission of electrons 16*a*, the secondary emission of electrons 16*a* reacts with the fluorescent material to generate visible light. The visible light is transmitted through the transparent faceplate 73 for viewing. A power supply and image display circuit unit 80, as shown in FIG. 3, is provided for supplying power and as the control circuit for the field emission display device to control image display of the field emission display device. The power supply and image display circuit unit 80 supplies and adjusts the voltage potential and current to each electrode and the electron amplification electrode in order to generate images.

As shown in FIG. 3, the Va, V1, Vg, and Vc provide the voltage sources for the upper electrode layer 72, the first electron amplification electrode 22, the second electrodes 15, and the first electrode 12, respectively.

Figure 7:
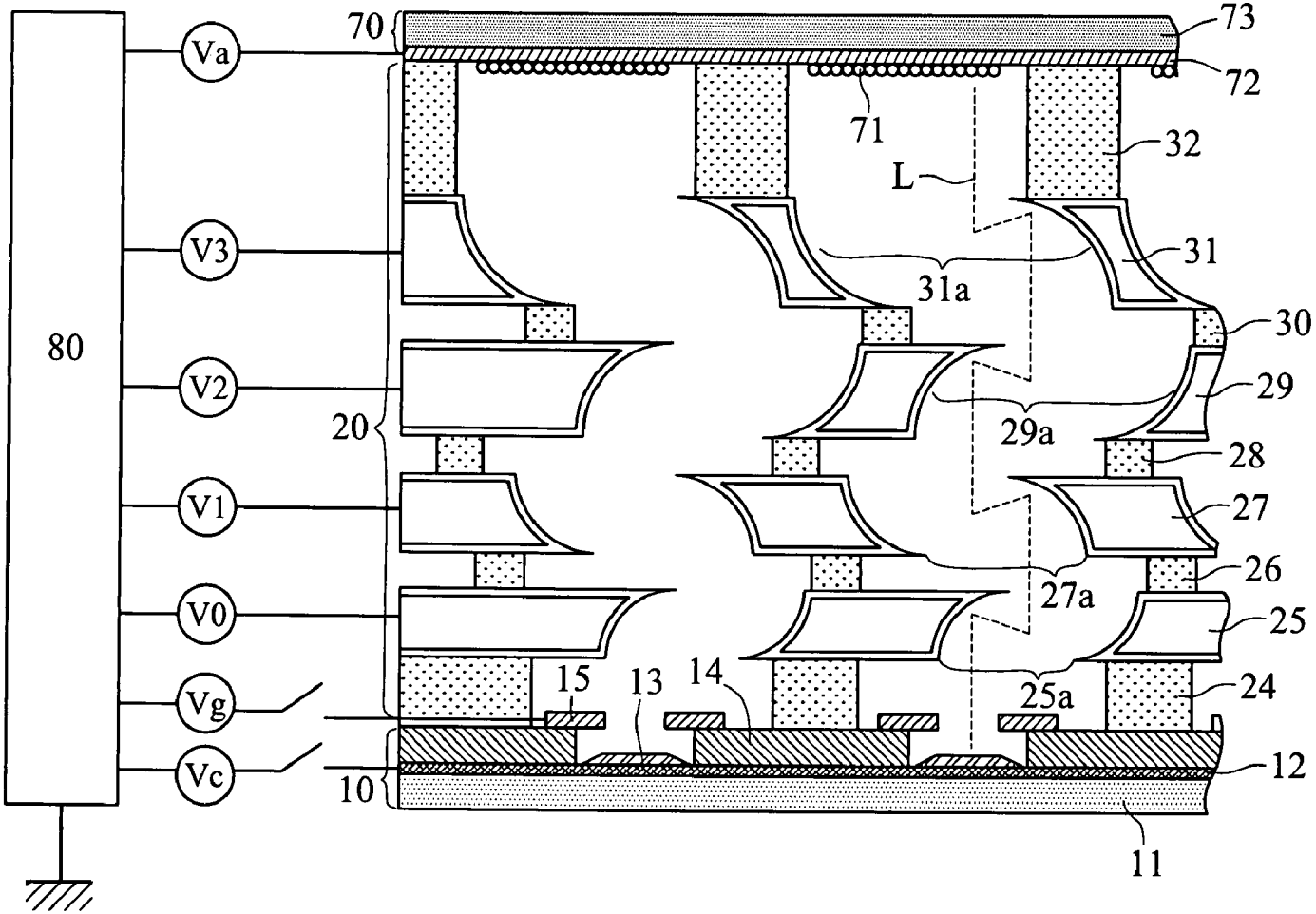
FIG. 7 is a cross-sectional schematic view of the FED device in a second embodiment of the invention.

As shown in FIG. 7, the second embodiment is similar to the first embodiment. However, in the second embodiment the electron amplification unit 20 comprises a multi-electron amplification electrodes and multi-insulating layers. The primary emission of electrons 16 emitted from the cathode emitter unit 10 bombards the multi-electron amplification materials in order to amplify the primary emission of electrons 16 and to provide a higher electron amplification factor.

The electron amplification unit 20 contains a fourth insulating layer 24, a second electron amplification electrode 25, a fifth insulating layer 26, a third electron amplification electrode 27, a sixth insulating layer 28, a fourth electron amplification electrode 29, a seventh insulating layer 30, a fifth electron amplification electrode 31, and an eighth insulating layer 32. The fourth insulating layer 24, the fifth insulating layer 26, the sixth insulating layer 28, the seventh insulating layer 30, and the eighth insulating layer 32 are composed of a plurality of insulating pillars or continuous structure with hollow tubes and are sandwiched between each electron amplification electrode. The insulating layers are provided to isolate every electron amplification electrode so as not to create voltage potential when the power supply and image display circuit unit 80 applies a voltage drop to each electron amplification electrode.

The second electron amplification electrode 25, the third electron amplification electrode 27, the fourth electron amplification electrode 29, and the fifth electron amplification electrode 31 are also composed of metal plates with many apertures 25*a*, 27*a*, 29*a* and 31*a*. Each aperture 25*a*, 27*a*, 29*a* and 31*a* has an inclined wall with the electron amplification material.

The sizes and positions of the apertures 25*a*, 27*a*, 29*a* and 31*a* must be arranged to generate an effective electron amplification effect. As shown in FIG. 7, the aperture 31*a* of the fifth electron amplification electrode is largest in size with the aperture 29*a* of the fourth electron amplification electrode 29 being second largest, the aperture 27*a* of the third electron amplification electrode 27 third largest, and the aperture 25*a* of the second electron amplification electrode 25 smallest.

In the electron amplification unit 20, the aperture 31*a* in the fifth electron amplification electrode 31 and the aperture 25*a* in the second electron amplification electrode 25 do not overlap, so as to stop the backflow of cations and prevent the accumulation of anode material and fluorescent material on the cathode emitters 13 or the second electrodes 15. This increases the lifetime of the field emission display device.

The voltage potential applied to two adjacent electrodes makes the primary emission of electrons 16 emitted from the cathode emitter unit 10 move toward the faceplate unit 70. The pathway L of the primary emission of electrons 16 shows that the electron amplification material of the second electron amplification electrode 25 is bombarded with the primary emission of electrons 16 to generate the secondary emission of electrons. Then, the electron amplification material of the third electron amplification electrode 27 bombarded with the secondary emission of electrons 16 generates a third emission of electrons. The electron amplification material of the fourth electron amplification electrode 29 bombarded with the third emission of electrons generates a fourth emission of electrons. The electron amplification material of the fifth electron amplification electrode 31 bombarded with the fourth emission of electrons generates a fifth emission of electrons. The fluorescent material of the light-emitting layer 71 bombarded with the fifth emission of electrons generates visible light. The visible light is transmitted through the transparent faceplate 73 for viewing.

The power supply and image display circuit unit 80 shown in FIG. 7 is provided to supply power and as the control circuit of the field emission display device to control image display of the field emission display device. The power supply and image display circuit unit 80 supplies and adjusts the voltage potential and current to each electrode and the electron amplification electrode in order to generate images.

As shown in FIG. 7, the Va, V3, V2, V1, V0, Vg, and Vc provide the voltage sources for the upper electrode layer 72, the fifth electron amplification electrode 31, the fourth electron amplification electrode 29, the third electron amplification electrode 27, the second electron amplification electrode 25, the second electrodes 15, and the first electrode 12, respectively.

The first and second embodiments only take up to second and fifth electron amplifications for example. However, the number of electrode layers with electron amplification material depends on the required electron amplification.

The field emission display device of the invention can be applied to TVs, monitors, notebook computers, panel computers, PDAs, mobile phones, digital video cameras, digital cameras, video game machines, money counter machine, and so on. The field emission display device can also be applied to medical equipment like monitors, oscilloscopes, and display devices. Finally, the field emission display device can be applied to display devices used in high brightness environments that require high brightness and contrast, such as car GPSs, and dashboards for cars, airplanes, or boats.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A field emission display device, which comprises:

a cathode emitter unit, for providing primary emission of electrons;

an electron amplification unit, disposed upon the cathode emitter unit, to generate electron amplification effect of the primary emission of electrons and support the field emission display device, the electron amplification unit comprises:

at least two insulating layers and an electrode layer, the electrode layer is a metal thin film with a plurality of apertures and is placed between the insulating layers, a surface of the electrode layer is provided with an electron amplification material, the insulating layers are provided for electrical insulation;

a faceplate unit, which comprises;

an upper electrode layer, which is made of a transparent conductive material and is disposed upon the electron amplification unit, a lower surface of the upper electrode layer is provided with a light emissive layer; and a transparent faceplate, which is disposed upon the upper electrode layer; and a power supply and image display circuit unit, providing the power source of the field emission display device and controlling image display of the field emission display device;

when the cathode emitter unit, the electrode layer and the upper electrode layer are biased by the power supply and image display circuit unit, the primary emission of electrons from the cathode emitter unit move toward the faceplate unit, whereby secondary emissions of electrons are produced when the electron amplification material of the electrode layer is bombarded by the primary emission of electrons, the secondary emissions of electrons pass through the aperture and bombard the light emissive layer, to make the light emissive layer emit fluorescence, the fluorescence is emitted through the transparent faceplate for viewing;

wherein the insulating layers are composed of a plurality of insulating pillars.

2. The field emission display device of claim 1 further comprising:

a substrate;

a first electrode, disposed upon the substrate;

a plurality of cathode emitters, disposed upon the first electrode at appropriate position for providing the primary emission of electrons;

a first insulating layer, which is composed of a plurality of insulators, each cathode emitters is electrically separated by each insulator; and a plurality of second electrodes, disposed upon the adjacent insulators;

wherein, each cathode emitters emits the primary emission of electrons at a predetermined time is controlled by the application of the voltage potential between the first electrode and each second electrode.

3. The field emission display device of claim 2 wherein the cathode emitters are made of a cathode emitting material.

4. The field emission display device of claim 1 wherein the cathode emitter unit is selected from the group consisting of a point emitter, a wedge emitter, a thin film amorphic diamond emitter, a thin film edge emitter, a surface emitter, an edge emitter, and a carbon nano tube emitter.

5. The field emission display device of claim 1 wherein the shape of a wall inside the aperture is selected from the group consisting of a concave inclined plane, a flat inclined plane, a vertical plane and a protruding inclined plane.

6. The field emission display device of claim 1 wherein the electron amplification material is selected from the group consisting of an Ag—Mg alloy, a Cu—Be alloy, a Cu—Ba alloy, a Au—Ba alloy, a Au—Ca alloy, a W-B a-Au alloy, and an oxide of beryllium, magnesium, calcium, strontium, and barium.

7. The field emission display device of claim 1 wherein the material of the upper electrode layer is an indium tin oxide or other transparent conductive oxides.

8. The field emission display device of claim 1 wherein the light emissive layer is composed of a fluorescent material.

9. The field emission display device of claim 1 wherein the transparent faceplate is composed of a glass material.

10. The field emission display device of claim 1 wherein the transparent faceplate is composed of a transparent plastic.

11. The field emission display device of claim 1 wherein the electron amplification unit further comprising a plurality of insulating layers, the electrode layer is sandwiched between two of the insulating layers, the size of the apertures on each electrode layer become larger from the cathode emitter unit toward the faceplate unit, and the apertures on the top and the bottom of the electrode layers do not overlap.

* * * * *

UNITED STATES PATENT AND TRADEMARK OFFICE

CERTIFICATE OF CORRECTION

PATENT NO. : 7,208,866 B2
APPLICATION NO. : 10/868221
DATED : April 24, 2007
INVENTOR(S) : Jeng-Maw Chiou et al.

It is certified that error appears in the above-identified patent and that said Letters Patent is hereby corrected as shown below:

On The Title Page: Please correct item 73 to read as follows:

Item --(73) Assignee: Industrial Technology Research Institute, Chu-Tung, Hsinchu (TW)--

Signed and Sealed this

Fourth Day of September, 2007

JON W. DUDAS
*Director of the United States Patent and Trademark Office*